US005491375A

United States Patent [19]

Iwasaki

[11] Patent Number: 5,491,375

[45] Date of Patent: Feb. 13, 1996

[54] CATHODE, ELECTRON GUN, AND CATHODE-RAY TUBE HAVING A HEATING ELEMENT FOR USE DURING COLD ELECTRON EMISSON

[75] Inventor: Yasuo Iwasaki, Nagaokakyo, Japan

[73] Assignee: Mitsubishi Denki Kabushiki Kaisha, Tokyo, Japan

[21] Appl. No.: 246,710

[22] Filed: May 20, 1994

[30] Foreign Application Priority Data

Dec. 22, 1993 [JP] Japan ..... 5-324144

[51] Int. Cl.[6] ..... H01J 29/50

[52] U.S. Cl. ..... 313/409; 313/422; 313/591

[58] Field of Search ..... 313/409, 411, 313/414, 422, 591, 624, 310, 309, 336, 337, 340, 341, 441, 449

[56] References Cited

U.S. PATENT DOCUMENTS 3,872,351 3/1975 Smith et al. ..... 313/449
4,019,077 4/1977 Sakitani ..... 313/441
4,625,143 11/1986 Kobayashi ..... 313/409

FOREIGN PATENT DOCUMENTS 48-90467 11/1973 Japan .
2-226635 9/1990 Japan .

*Primary Examiner*—Walter E. Snow
*Assistant Examiner*—Vip Patel

[57] ABSTRACT

A cathode, an electron gun, and a cathode-ray tube, having a configuration wherein a heat source for heating an electron emission portion in which an electric field is applied to the tip so that electrons are pulled out is disposed, whereby instability and reduction in amount of emitted electron rays which are due to an effect of adsorbed gas molecules can be prevented from occurring.

15 Claims, 12 Drawing Sheets

CATHODE, ELECTRON GUN, AND CATHODE-RAY TUBE HAVING A HEATING ELEMENT FOR USE DURING COLD ELECTRON EMISSON

BACKGROUND OF THE INVENTION

1. Field of the Invention

The invention relates to a cathode in which electrons are emitted by applying a voltage to a position in the vicinity of a minute-projection, an electron gun having the cathode, and a cathode-ray tube having the electron gun.

2. Description of Related Art

FIG. 1 is a schematic section view showing a configuration of a monochrome cathode-ray tube. In the figure, a vacuum enclosure 15 which is made of glass and has a shape of a conventional cathode-ray tube consisting of a panel portion 28, a funnel portion 16, and a neck portion 2. Layers such as a fluorescent layer 18, and a metal back layer 19 are formed on the inner face of a face plate 17 of the panel portion 28 so that these layers constitute a fluorescent screen. An electron gun 1 is disposed in a sealed manner in the neck portion 2. The funnel portion 16 is provided with an anode button 20 through which a high voltage is applied to the electron gun 1. A deflection yoke 22 is attached to the outside of the vacuum enclosure 15 in the vicinity of the portion where the funnel portion 16 and the neck portion 2 are joined with each other. Furthermore, a getter 23 is attached to the inside of the vacuum enclosure 15 through a metal spring 24.

Electron rays 21 are emitted from the electron gun 1 and accelerated and focused by a high voltage of about 20 to 30 KV which is supplied through the anode button 20 from an external high voltage source The electron rays 21 are then electromagnetically deflected by a magnetic field due to the deflection yoke 22 to impinge on the fluorescent screen, whereby the fluorescent layer 18 is excited to emit light.

In the operation of the cathode-ray tube, the degree of vacuum of the vacuum enclosure 15 is important in relation to operation properties and life properties. In a production process of a cathode-ray tube, therefore, the whole of the vacuum enclosure 15 is externally heated (about 400° C.) so as to be sufficiently degassed. After the vacuum enclosure 15 is evacuated in this way, the degree of vacuum of the vacuum enclosure 15 is enhanced to the level of $5\times10^{-5}$ Torr. Then, the getter 23 is used to further enhance the degree of vacuum to the level of $10^{-8}$ Torr. The getter 23 has a configuration in which a metal such as barium (Ba) is filled in a metal ring. When a high frequency heating is conducted from the outside of the vacuum enclosure 15, the metal such as barium (Ba) is scattered or evaporated to enhance the degree of vacuum. Immediately after the getter material is scattered or evaporated in the vacuum enclosure 15, the degree of vacuum of the vacuum enclosure 15 is slightly lowered. Since residual gas molecules within the vacuum enclosure 15 are thereafter adsorbed by the active getter material, the degree of vacuum of the vacuum enclosure 15 is gradually enhanced. In this case, when a current aging is conducted while emitting electron rays from the electron gun 1, residual gas molecules within the vacuum enclosure 15 are ionized to be activated, and therefore the adsorption on the getter material is promoted so that the degree of vacuum of the vacuum enclosure 15 is abruptly enhanced. This getter effect causes the degree of vacuum of the vacuum enclosure 15 to finally reach the level of $10^{-8}$ Torr. When the degree of vacuum of the vacuum enclosure 15 is at the level of $10^{-8}$ Tort, there arises no problem in operation properties and life properties of the cathode-ray tube.

FIG. 2 is a schematic enlarged section view showing only the neck portion 2 to illustrate in detail the configuration of the electron gun 1. The electron gun 1 may have various electrode configurations. As a typical example, a bi-potential electron gun 1 comprises a cathode which functions as an electron source, electrodes for pulling out electron rays from the cathode and accelerating them, and electrodes for focusing the emitted electron rays on the fluorescent screen. The cathode has a configuration in which a cylindrical base metal 26 is bottomed in the side of the panel portion 28, a cathode material 25 made of barium oxide ($Ba_2O_3$), and the like is applied to the outer surface of the bottom portion of the base metal 26, and a heater 27 is disposed inside the bottom portion. The cathode material 25 is heated by the heater 27 to about 750° to 800° C. to emit thermoelectrons. The emitted thermoelectrons are controlled and accelerated by a first grid electrode 3, a second grid electrode 9, and a third grid electrode 10, and then focused by a main electron lens formed between the third grid electrode 10 and a fourth grid electrode I1, to be impinged in a spot-like manner on the fluorescent layer 18 of the fluorescent screen. The electron rays cause the fluorescent layer 18 in FIG. 1 to be excited to emit light, resulting in that an image is produced on the fluorescent screen. The electron gun 1 having such a configuration is fixed at the side of the fourth grid electrode 1i to the inner wall of the neck portion 2 by a contactor 12. The contactor 12 guides to the fourth grid electrode 11 the high voltage which is generated by the external high voltage source and guided through the anode button 20 and a conductive dag 102. The conductive dag is applied on the inner wall of the vacuum enclosure 15. Voltages which are to be respectively applied to the electrodes other than the fourth grid electrode 11, i.e., the first grid electrode 3, the second grid electrode 9, the third grid electrode 10, and the cathode (the base metal 26, and the heater 27) are introduced through lead-in terminals 101 disposed in the bottom of the neck portion 2.

In the electron gun 1 using such a hot cathode, the level of the emission current is restricted by the properties of the cathode material 25. Therefore, it is difficult to sufficiently satisfy recent requirements for a large-sized and high bright cathode-ray tube. In this system, furthermore, the cathode material 25 must be heated to a considerably high temperature, and therefore a counter-measure against heat must be taken in electrodes surrounding the cathode material 25. For example, it is required to prevent the electrodes from being thermally deformed. In some cases, furthermore, the heating of the cathode material 25 to a high temperature causes a part of the cathode material 25 to be evaporated to adhere to the surrounding electrodes, thereby producing a problem in withstand voltage.

In order to solve these problems, a cathode-ray tube using a cold cathode is disclosed in Japanese Patent Application Laid-Open No. 48-90467. FIG. 3 is a schematic section view showing a configuration of the electron gun 1 using a cold cathode. In the cold cathode 5, a silicon (Si) substrate 7 is fixed onto a cold cathode pedestal 4. A number of conical minute projections **7*a* are formed on the surface of the silicon substrate 7 by a photolithography process (the pitch of the microcones is 1 to 10 μm). Also, column-like minute projections 7*b* are formed on the surface. An electron pulling electrode 6 is formed at the upper portion of each of the minute projections 7*b* by a similar photolithography process in such a manner that it is in proximity to the tips of the minute projections 7*a*. The electron pulling electrodes 6 are connected to a lead wire 8. In the same manner as most of the other electrodes, a voltage is applied to the electron pulling electrodes 6 through the lead-in terminals 101 disposed in the bottom of the neck portion 2. The configuration except the cathode is identical with the cathode-ray tube shown in FIGS. 1 and 2**. Therefore, corresponding elements are designated by the same reference numerals and their description is omitted.

In the cold cathode 5, since the electron pulling electrodes 6 and the minute projections 7*a* consisting of microcones are close in distance to each other, the electric field is caused to concentrate at the tips of the minute projections 7*a* only by applying a voltage of about several tens to one hundred volts to the electron pulling electrodes 6, so that electrons are emitted from the tips. In the same manner as the case of the conventional hot cathode, the electrons pulled out by the electron pulling electrodes 6 are controlled and accelerated by the first grid electrode 3, the second grid electrode 9, and the third grid electrode 10, and then focused by the main electron lens formed between the third grid electrode 10 and the fourth grid electrode 11. The electron rays are then impinged in a spot-like manner on the fluorescent layer 18 of the fluorescent screen, whereby causing the fluorescent layer 18 to be excited to emit light, resulting in that an image is produced on the fluorescent screen.

FIG. 4 is a schematic section view of a main portion showing the case where such a cold cathode is applied to a flat cathode-ray tube. A vacuum enclosure 29 of the flat cathode-ray tube has a substantially box-like shape, and which comprises a front glass plate 30 and a back glass plate 14. In the case of a color display, a fluorescent screen on which G (green) fluorescent dots 31, B (blue) fluorescent dots 32, and R (red) fluorescent dots 33 are arranged in a mosaic manner is formed on the inner face of the front glass plate 30. On the mosaic-like fluorescent screen, disposed is a metal back film 34 which is made of Al (aluminum) and functions as an anode and a light reflecting film. Cold cathode groups 36 for exciting the G (green) fluorescent dots 31, cold cathode groups 37 for exciting the B (blue) fluorescent dots 32, and cold cathode groups 38 for exciting the R (red) fluorescent dots 33 are formed on the inner face of the back glass plate 14, in such a manner that they respectively correspond to the G, B and R fluorescent dots 31, 32 and 33. In the same manner as the cold cathode shown in FIG. 3, each of the cold cathode groups 36, 37 and 38 comprises a number of minute projections 7*a* and electron pulling electrodes 6 which are in proximity to the minute projections 7*a* The electron pulling electrodes 6 are arranged in an X-Y matrix form so that the cold cathode groups 36, 37 and 38 can control the amount of respective electron rays emitted toward the G, B and R fluorescent dots 31, 32 and 33. It is not required to interpose any thing between the front glass plate 30 on which the fluorescent screen is formed, and the back glass plate 14 on which the cold cathode groups 36, 37 and 38 are formed. Therefore, the distance between the front glass plate 30 and the back glass plate 14 can be reduced to a very small value. Consequently, this technique is recently expected to realize an ultra-thin flat cathode-ray tube. The degree of vacuum of the vacuum enclosure 29 which is defined by the front glass plate 30 on which the fluorescent screen is formed, and the back glass plate 14 on which the cold cathode groups 36, 37 and 38 are formed is important in the view points of the electron emission properties of the cold cathodes. When a getter similar to that described above is used, the space within the vacuum enclosure 15 can be maintained at a high In such cathode-ray tubes, i.e., the cathode-ray tube which has the electron gun 1 using the cold cathode 5 according to the electric field emission, and the flat cathode-ray tube using the cold cathode 5 in which the cold cathode groups are arranged in a mosaic manner corresponding to t, he fluorescent dots, the influence of a small amount of residual gas molecules and acting on the electron emission of the minute projections 7*a* of the cold cathode 5 cannot be neglected even when the internal space of the vacuum enclosure 15 or 29 is maintained at a considerably high vacuum as described above. One of the causes of this phenomenon is the fact that the cold cathode 5 easily adsorbs gas molecules because it is configured by arranging a number of minute microcones (having a size of, for example, 1 to 3 μm) in the pitch of, for example, several microns and therefore the whole surface area of the cathode is very large.

In the cathode-ray tube which the electron gun 1 using the cold cathode 5 shown in FIG. 3 and according to the electric field emission, even when the degree of vacuum of the vacuum enclosure 15 is maintained at a high vacuum or at the level of $10^{-8}$ Tort by the above-mentioned effect of the getter, and the like, adsorbed gas molecules are gradually released from the fluorescent screen struck by the electron rays 21, the inner surface of the glass plate of the vacuum enclosure 15, and the vicinity of each electrode of the electron gun 1. The released gases are again adsorbed by the tips of the minute projections 7*a* of the cold cathode 5. Particularly, the electron emission portion of the tip of each minute projections 7*a* is sharpened to an atomic level, and therefore may largely be affected even when it adsorbs several gas molecules. This causes the amount of electron rays emitted from the electron gun 1 to be unstable, and the amount itself to be reduced. As a result, there arise problems that the light emission of the fluorescent screen due to the electron rays becomes unstable, and that the light emission brightness of the fluorescent screen is lowered.

In the same manner as the case described above, also in the case of the flat cathode-ray tube shown in FIG. 4 and using the cold cathode, adsorbed gas molecules are gradually released from the fluorescent screen, and the inner surface of the vacuum enclosure 29, and again adsorbed by the tips of the minute projections 7*a*. This causes the amount of electron rays emitted from the cold cathode groups 36, 37 and 38 to be unstable, and the amount itself to be reduced, As a result, there arise problems that the light emission of the fluorescent screen due to the electron rays becomes unstable, and that the light emission brightness of the fluorescent screen is lowered.

SUMMARY OF THE INVENTION

The invention has been conducted in order to solve the above-discussed problems. It is an object of the invention to provide a cathode, an electron gun, and a cathode-ray tube in which a cold cathode is provided with a heat source, whereby instability and reduction in amount of emitted electron rays which are due to an effect of adsorbed gas molecules can be prevented from occurring.

It is another object of the invention to provide a cathode-ray tube in which the light emission of a fluorescent layer is stabilized and the light emission brightness is improved.

According to the invention, a heat source is provided to heat an electron emission portion from which electrons are emitted by applying an electric field to the tip of the portion. By heating the electron emission portion, therefore, gas molecules adhering to the electron emission portion are removed and prevented from again adhering thereto.

It is a further object of the invention to provide a cathode in which the disposition of the heat source does not require an increased installation space.

Furthermore, the heat source may be placed in the vicinity of the base of the electron emission portion. This configuration can suppress the increase of the whole size even when the heat source is disposed.

It is a still further object of the invention to provide a cathode which can avoid an adverse influence produced by excessively heating the electron emission portion.

Hence, the cathode has a configuration which has control means for controlling the temperature of the heat source within the range of 100° to 500° C. Since this temperature is much lower than the heating temperature employed in a conventional hot cold cathode, the cathode is substantially free from the problems such as thermal deformation.

Furthermore, control means for controlling the heating temperature of the heat source so that the amount of electrons emitted from the electron emission portion is constant. This can stabilize surely and efficiently the amount of emitted electron rays.

The above and further objects and features of the invention will more fully be apparent from the following detailed description with accompanying drawings.

DESCRIPTION OF THE PREFERRED EMBODIMENTS

Hereinafter, the invention will be described with reference to the drawings showing its embodiments.

Embodiment 1

Figure 1:
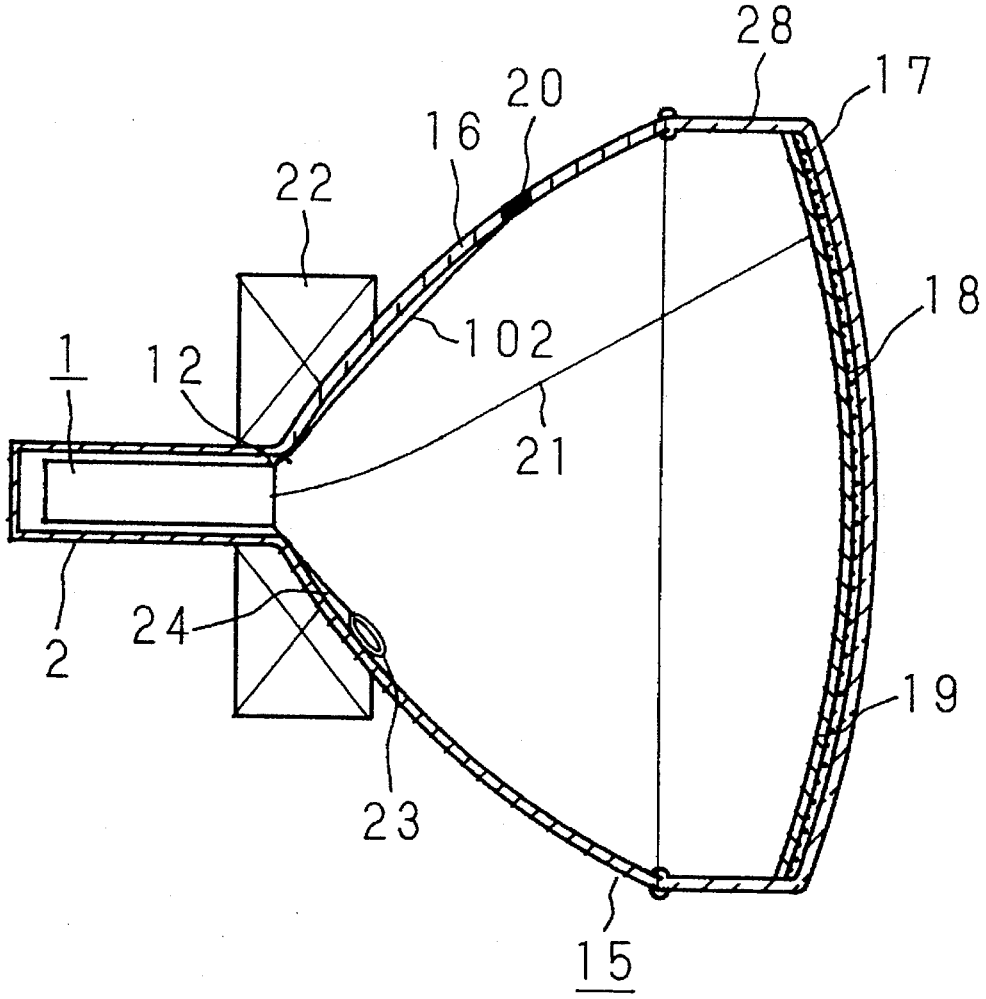
FIG. 1 PRIOR ART
FIG. 1 is a schematic section view showing a conventional cathode-ray tube.
Figure 2:
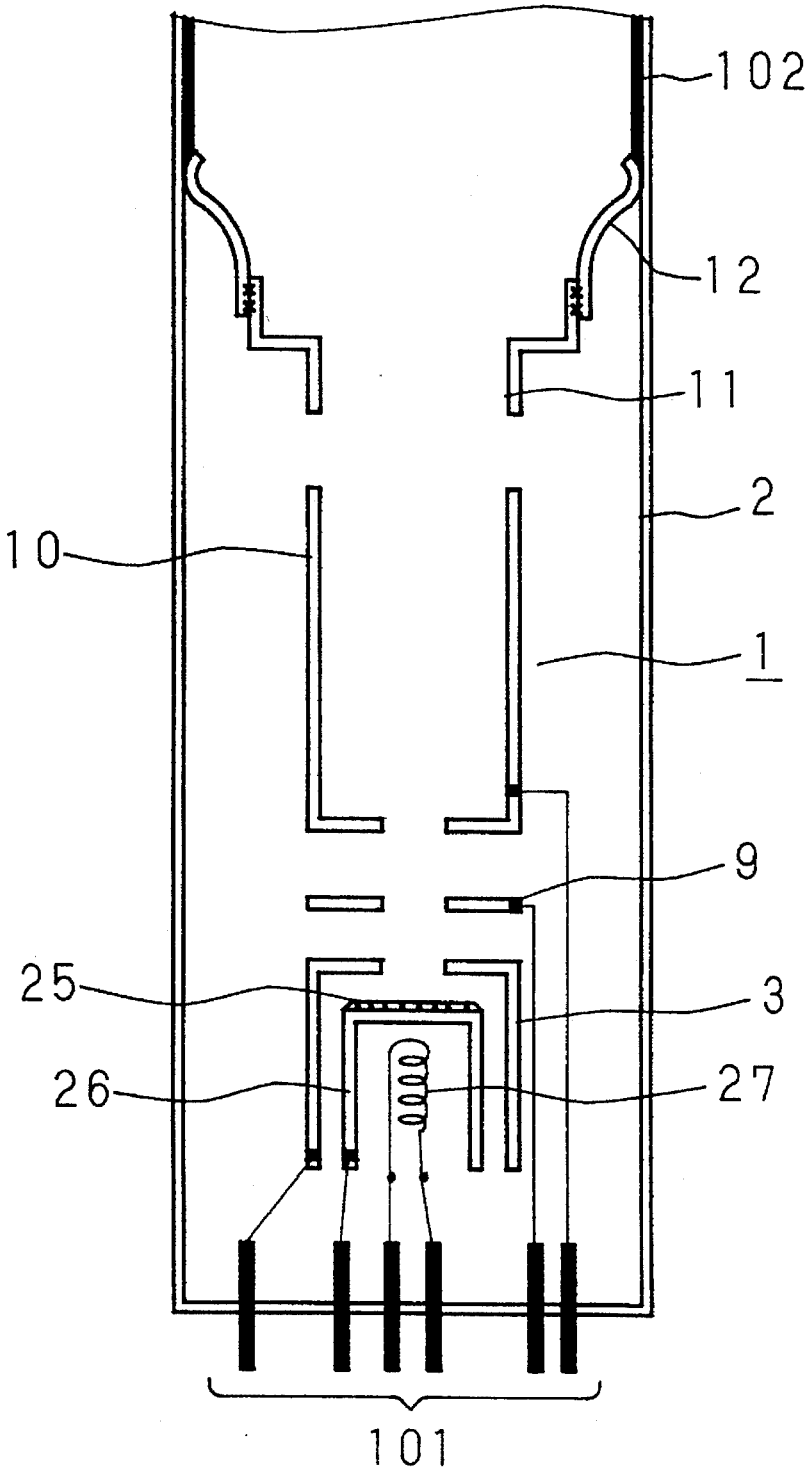
FIG. 2 PRIOR ART
FIG. 2 is a schematic enlarged section view showing a neck portion of FIG. 1.
Figure 3:
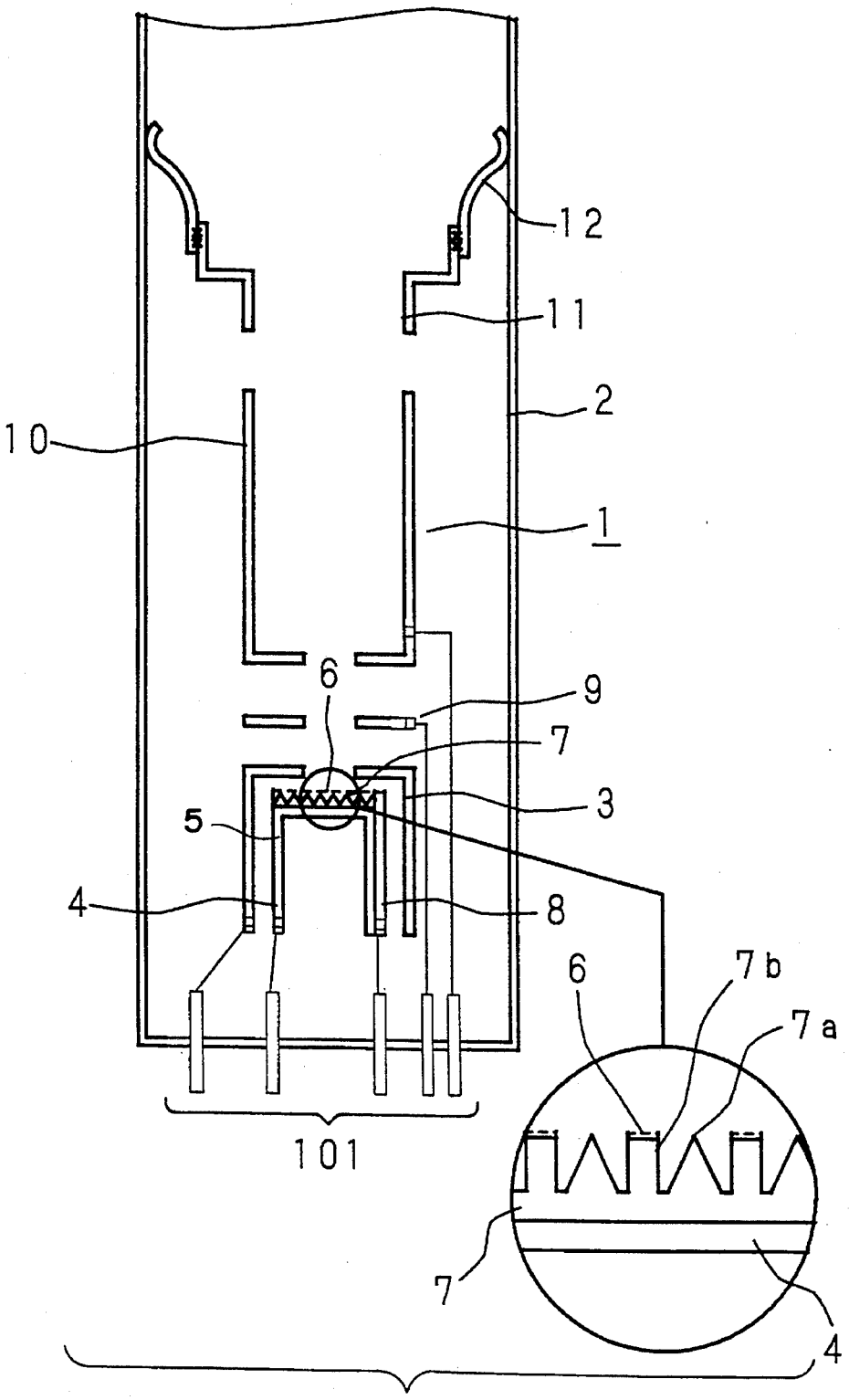
FIG. 3 PRIOR ART
FIG. 3 is a schematic enlarged section view showing a neck portion of a conventional cathode-ray tube using a cold cathode.
Figure 4:
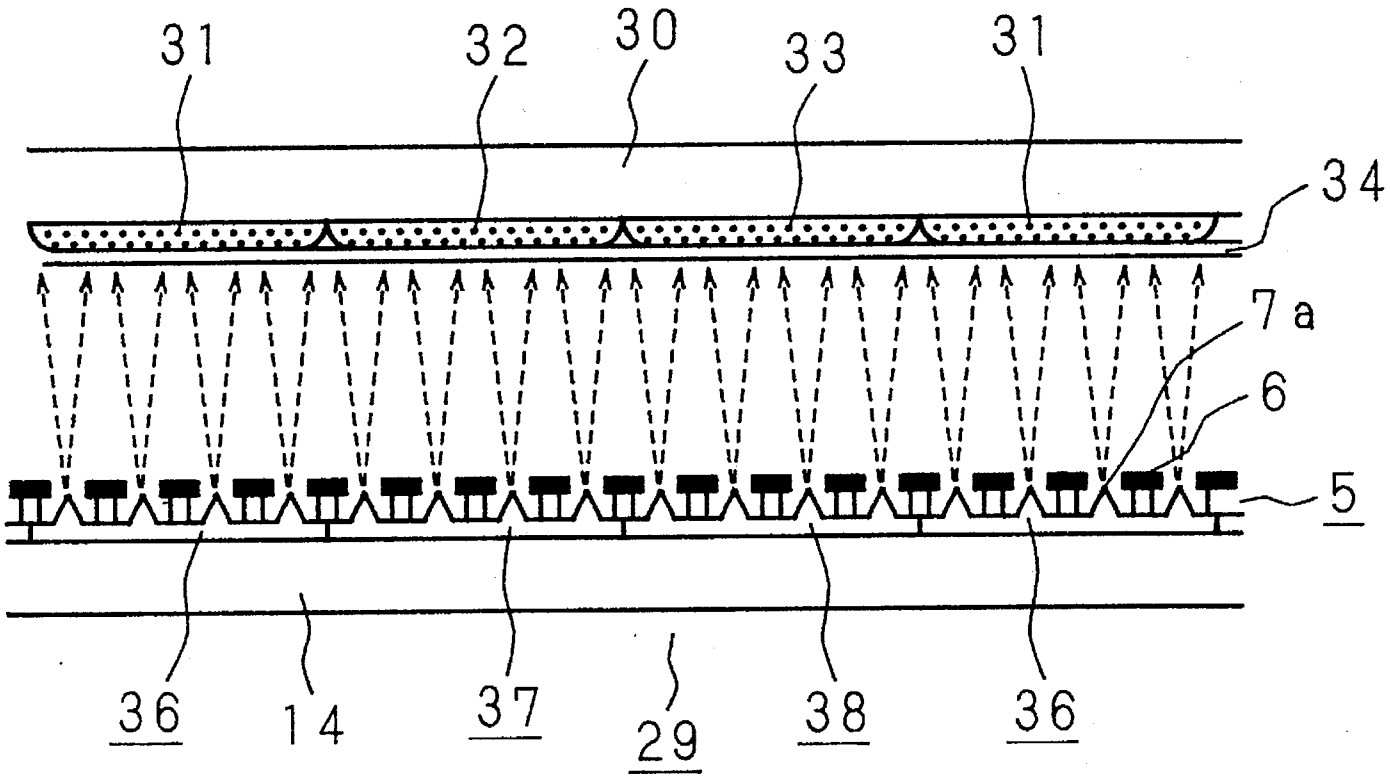
FIG. 4 PRIOR ART
FIG. 4 is a schematic section view showing a main portion of a conventional flat cathode-ray tube using a cold cathode.
Figure 5:
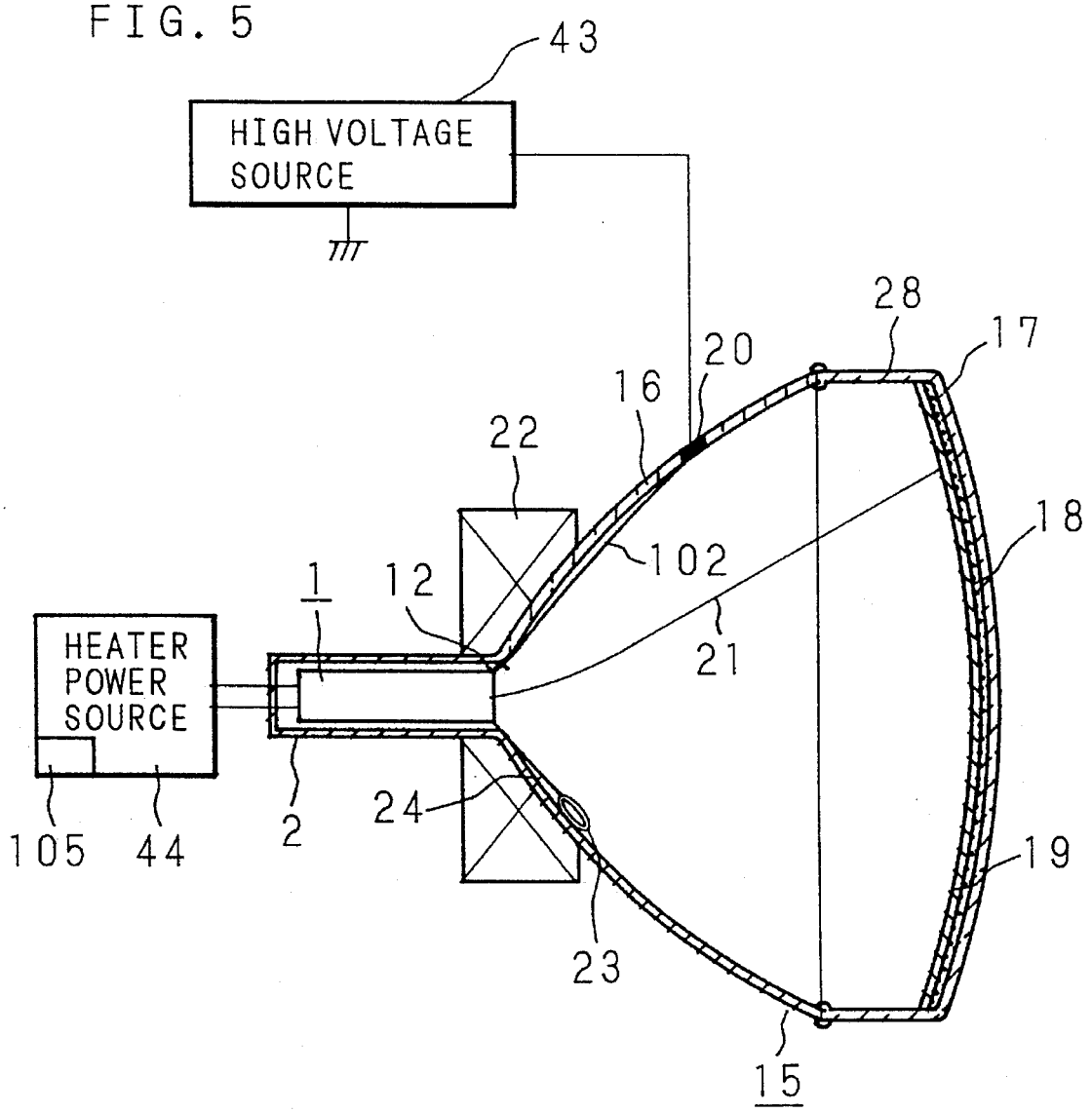
FIG. 5 is a schematic section view showing the cathode-ray tube of the invention.
Figure 6:
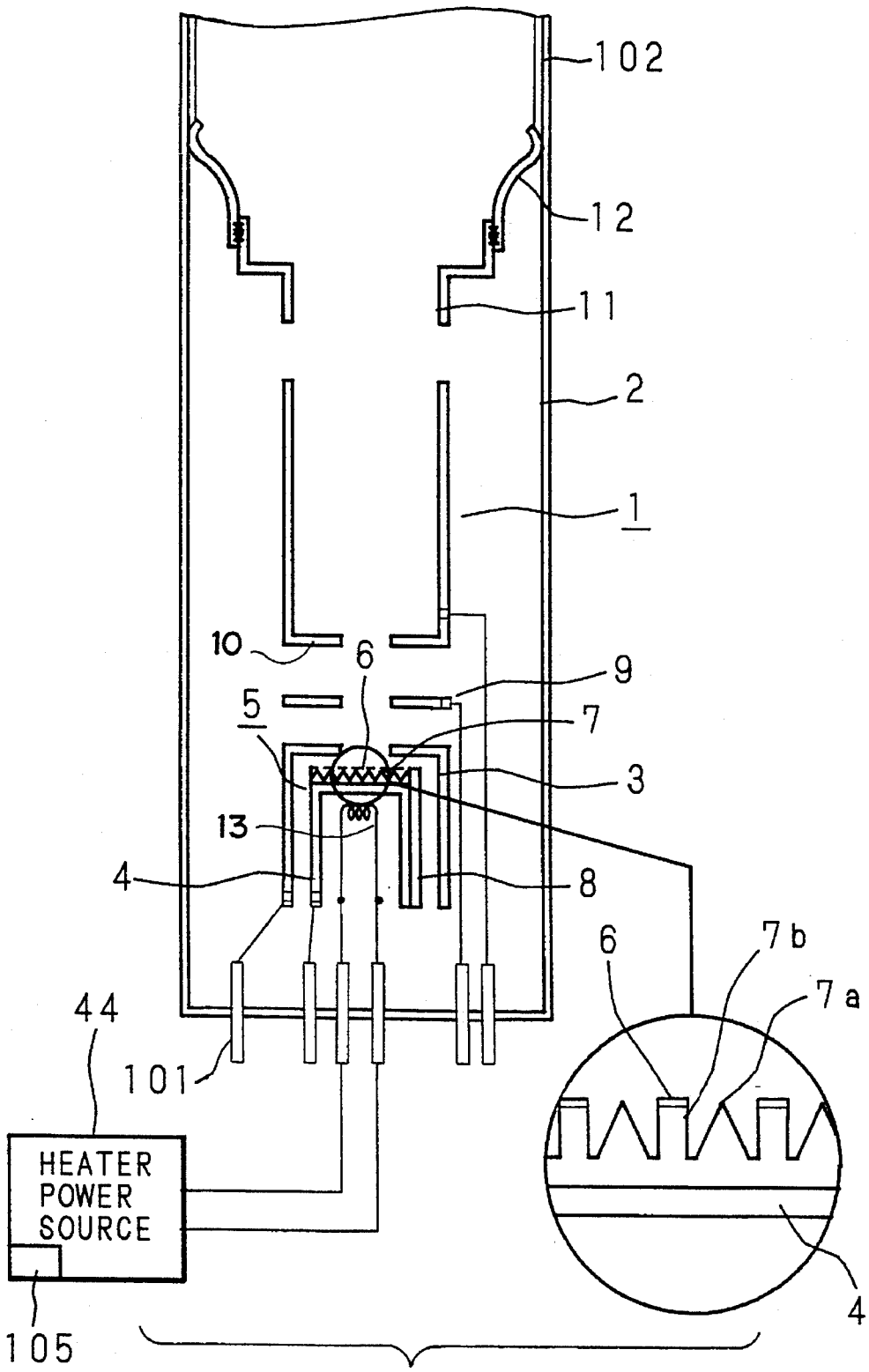
FIG. 6 is a schematic enlarged section view showing a neck portion of FIG. 5.

FIG. 5 is a schematic section view showing a cathode-ray tube having a cathode according to the invention, and FIG. 6 is a schematic enlarged section view showing a neck portion of the cathode-ray tube. In the figures, a vacuum enclosure 15 which is made of glass and has a shape of a conventional cathode-ray tube consisting of a panel portion 28, a funnel portion 16, and a neck portion 2. Layers such as a fluorescent layer 18, and a metal back layer 19 are formed on the inner face of a face plate 17 of the panel portion 28 so that these layers constitute a fluorescent screen. An electron gun 1 is disposed in a sealed manner in the neck portion 2. The electron gun 1 comprises a cold cathode 5 which functions as an electron source, electrodes (a first grid electrode 3, a second grid electrode 9, a third grid electrode 10, and a fourth grid electrode 11) for pulling out electron rays from the cathode and accelerating them and for focusing the emitted electron rays on the fluorescent screen A deflection yoke 22 which deflects electron rays 21 emitted from the electron gun 1 is attached to the outside of the vacuum enclosure 15 in the vicinity of the portion where the funnel portion 16 and the neck portion 2 are joined with each other. Furthermore, the funnel portion 16 is provided with an anode button 20 which is to be connected to an external high voltage source 43. A conductive dag 102 is applied on a region of the inner wall of the vacuum enclosure 15 which region extends from the position of the anode button 20 to the neck portion 2. A high voltage of about 20 to 30 KV is applied from the external high voltage source 43 to the electron gun 1 through the anode button 20 and the conductive dag 102.

The electron rays 21 which are emitted from the electron gun 1, then accelerated and focused are electromagnetically deflected by a magnetic field due to the deflection yoke 22 to impinge on the fluorescent screen, whereby the fluorescent layer 18 is excited to emit light.

As shown in FIG. 6, in the stage subsequent to the cold cathode 5 which will be described later, the electron gun 1 comprises the first grid electrode 3, the second grid electrode 9, the third grid electrode 10, and the fourth grid electrode 11 in this sequence. Electron ray passing holes are formed in each of the grid electrodes. The electron gun 1 is fixed at the side of the fourth grid electrode 11 to the inner wall of the neck portion 2 by a contactor 12. A high voltage is applied to the fourth grid electrode 11 through the anode button 20, the conductive dag 102, and the contactor 12. Voltages which are respectively applied to the electrodes other than the fourth grid electrode 11, i.e., the first grid electrode 3, the second grid electrode 9, and the third grid electrode 10 are introduced through lead-in terminals 101 disposed in the bottom of the neck portion 2.

When predetermined voltages are respectively applied to the first grid electrode 3, the second grid electrode 9, and the third grid electrode 10, electron rays are pulled out from the cold cathode 5 and accelerated. The accelerated electron rays are focused by a main electron lens which is formed by applying predetermined voltages to the third grid electrode 10 and the fourth grid electrode 11.

The cold cathode 5 is configured as follows: A silicon (Si) substrate 7 is fixed onto a cold cathode pedestal 4 having a cylindrical shape which is bottomed in the side of the first grid electrode 3. A number of conical minute projections **7*a* are formed (with the pitch of the microcones from 1 to 10 μm) on the surface of the silicon substrate 7 by a photolithography process. Also, column-like minute projections 7*b* are disposed on the surface. An electron pulling electrode 6 is formed at the upper portion of each of the minute projections 7*b* by a similar photolithography process in such a manner that it is in proximity to the tips of minute projections 7*a*. The electron pulling electrodes 6 are connected to a lead wire 8 so that a voltage is applied to the electron pulling electrodes 6 through the lead-in terminals 101 disposed in the bottom of the neck portion 2**.

A cold cathode heater 13 is disposed inside the cold cathode pedestal 4. The cold cathode heater 13 is connected through the lead-in terminals 101 to a heater power source 44 which is disposed outside the cathode-ray tube, so that the cold cathode heater 13 can directly heat the cold cathode 5. The heater power source 44 is provided with a control unit 105 for controlling the output of the power source.

Figure 7:
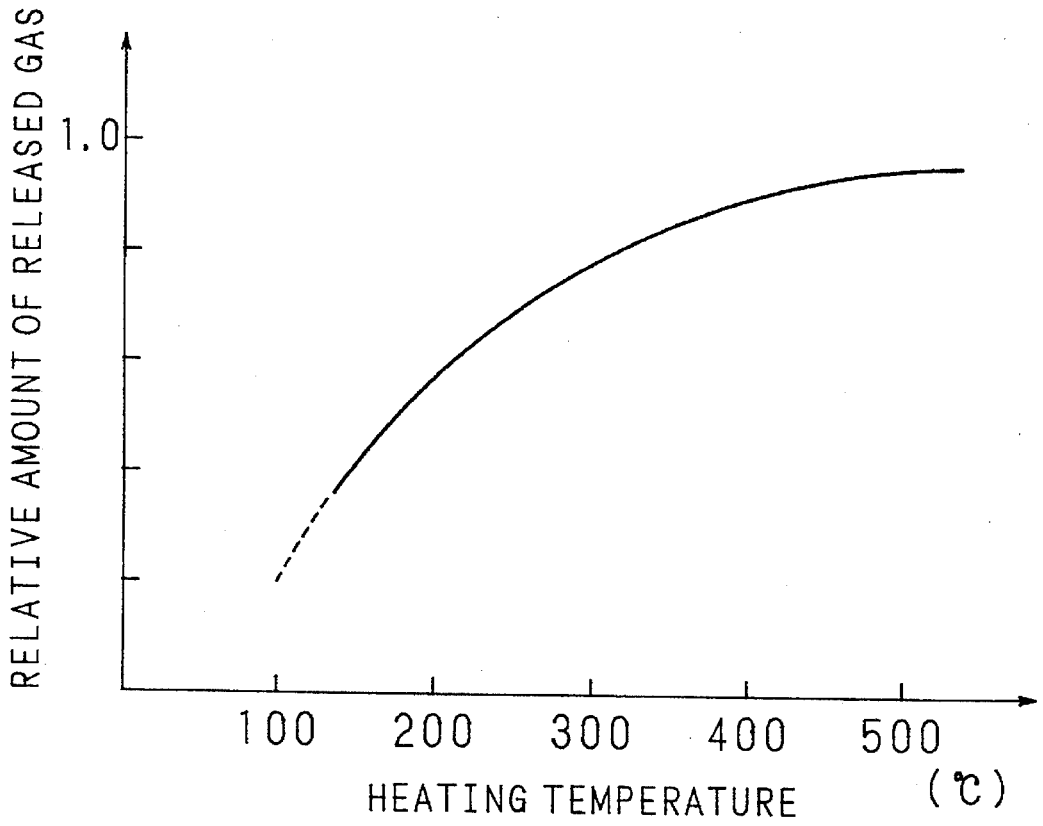
FIG. 7 is a graph showing the relationship between a heating temperature and a relative amount of released gas.

FIG. 7 is a graph showing the relationship between a heating temperature and a relative amount of released gas. The abscissa indicates a heating temperature and the ordinate indicates a relative amount of released gas while setting the released gas amount at 100° C. to be 1. The measurement results were obtained by measuring the level of an ionic current with using an ion gauge. As apparent from FIG. 7, in order to prevent gas molecules released from the fluorescent screen, and the like during the operation of the cathode-ray tube from being again adsorbed by the tips of the minute projections 7*a* of the cold cathode 5, it is sufficient to heat the tips of the minute projections 7*a* to about 100° C., and it is not necessary to intensely heat the cold cathode 5. In the case where the cold cathode 5 is heated with the object of positively removing gas molecules adsorbed to the tips of the minute projections 7*a* of the cold cathode 5 to clean the tips, it is usually sufficient to heat the tips to about 200° to 300° C. Even when the tips of the minute projections 7*a* of the cold cathode 5 are highly contaminated, gas molecules adsorbed to the tips can be removed away by heating the tips to about 500° C. In these heating processes, the temperatures are much lower than the heating temperature (750° to 800° C.) of a conventional hot cathode, and therefore the cold cathode 5 is substantially free from the above-mentioned problems such as thermal deformation.

The temperature control conducted on the cold cathode healer 13 by the control unit 105 will be described.

For example, a control is conducted in which the tips of the minute projections 7*a* of the cold cathode 5 are heated at the beginning of the operation to a relatively high temperature (500° C.), and thereafter the heating is not done until the stop of the operation or done intermittently at the fixed time intervals. Gas molecules adsorbed to the tips of the minute projections 7*a* can be removed away by the initial heating to about 500° C. When the minute projections 7*a* are further heated, it is possible to make gas molecules difficult to adhere to the tips of the minute projections 7*a*. In order to conduct more accurately the temperature control in this process, the temperature of the minute projections 7*a* or their vicinity is detected by a detector such as a thermocouple, or the control unit 105 is provided with a table in which the temperature can be inferred from the level of a current supplied to the cold cathode heater 13.

Figure 8:
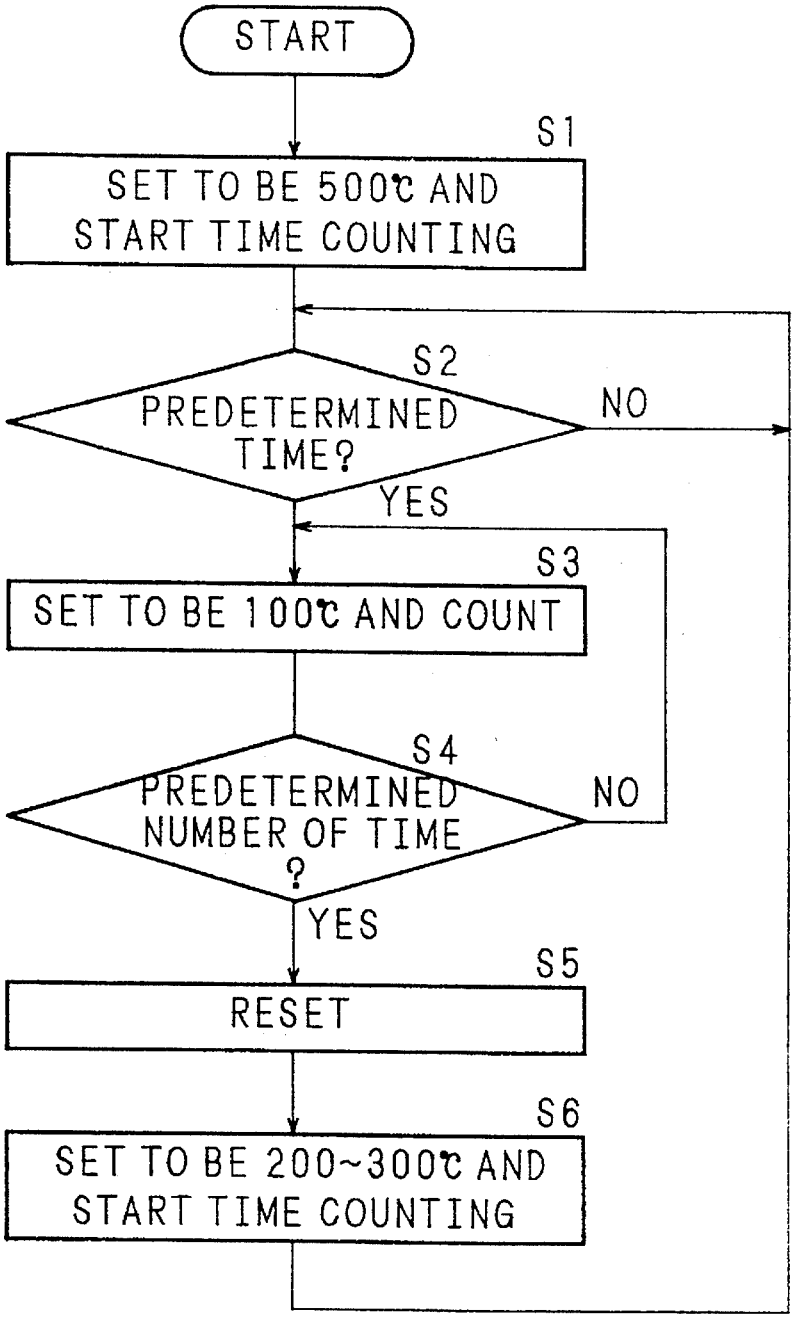
FIG. 8 is a flow chart showing a procedure of a control unit shown in FIG. 6.

FIG. 8 is a flow chart showing a procedure of controlling the temperature of the cold cathode heater 13 on the basis of the predetermined table.

At the beginning of the operation of the cathode-ray tube, a control signal indicating that the tips of the minute projections 7*a* are heated to a temperature of 500° C. by the cold cathode heater 13 is supplied from the control unit 105 to the heater power source 44. In response to this signal, the heating temperature is set to be 500° C., and the time counting is started (step S1). Then, it is judged whether or not the predetermined time has elapsed (step S2). When it is judged that it has not elapsed, the process of step S2 is repeatedly conducted until the predetermined time has elapsed. When it is judged in step S2 that the predetermined time has elapsed, the preset temperature is changed to 100° C. (step S3). It is then judged whether or not the heating process at 100° C. has been conducted a predetermined number of times (step S4). When the number of the heating processes has not yet reached the predetermined number, the process step returns to step S3. When the number of the heating processes has reached the predetermined number, the timer and the counter are reset (step S5), the temperature setting is changed to within 200° to 800° C., and the time counting is started (step S6). Thereafter, the process step returns to step S2, and the above-mentioned procedure is repeated. The above processes are repeated until the power is turned off.

Embodiment 2

Figure 9:
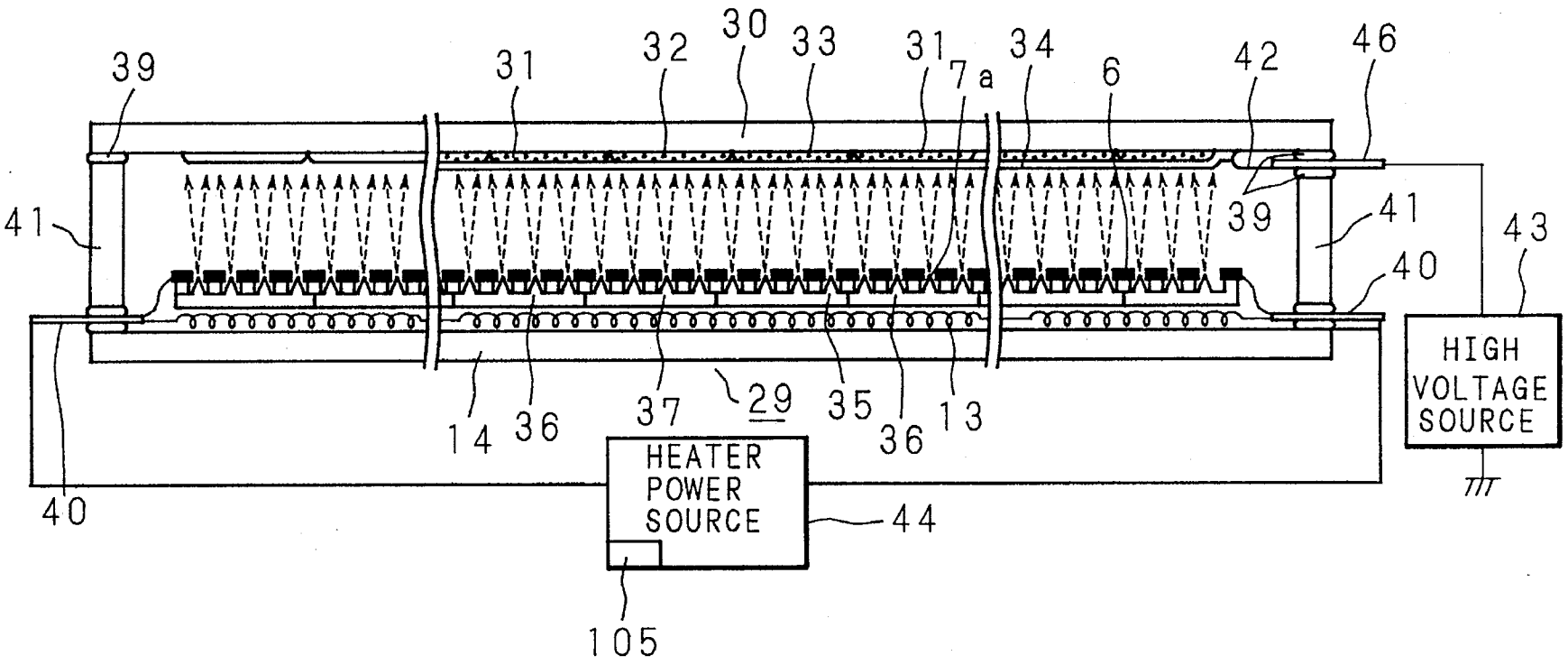
FIG. 9 is a schematic section view showing another embodiment of the cathode-ray tube of the invention.

FIG. 9 is a schematic section view showing another embodiment of the cathode-ray tube of the invention. In the embodiment, the cathode of the invention is applied to a color display flat cathode-ray tube. A vacuum enclosure 29 of the flat cathode-ray tube has a substantially box-like shape which comprises a front glass plate 30, a back glass plate 14, and side glass plates 41. A fluorescent screen on which G fluorescent dots 31, B fluorescent dots 32, and R fluorescent dots 33 are arranged in a mosaic manner is formed on the inner face of the front glass plate 30. On the mosaic-like fluorescent screen, disposed is a metal back film 34 which is made of Al (aluminum) and functions as an anode pole and a light reflecting film. The metal back film 34 is connected through a fluorescent screen conductive spring 42 to a number of lead-in terminals 46 which are disposed between the front glass plate 30 and the side glass plates 41. The lead-in terminals 46 are connected to the high voltage source 43 so that a high voltage is applied to the metal back film 34.

Cold cathode groups 36 for exciting the G fluorescent dots 31, cold cathode groups 37 for exciting the B fluorescent dots 32, and cold cathode groups 38 for exciting the R fluorescent dots 33 are formed on the inner face of the back glass plate 14, in such a manner that they respectively correspond to the G, B and R fluorescent dots 31, 32 and 33. In the same manner as the cold cathode shown in FIG. 6, each of the cold cathode groups 36, 37 and 38 comprises a number of minute projections 7*a* and electron pulling electrodes 6 which are in proximity to the minute projections 7*a*. The electron pulling electrodes 6 are arranged in an X-Y matrix form. A predetermined voltage is applied from a power source which is not shown to the electron pulling electrodes 6 through a number of lead-in terminals 40 which are disposed between the back glass plate 14 and the side glass plates 41, so that the cold cathode groups 36, 37 and 38 can control the amount of respective electron rays emitted toward the G, B and R fluorescent dots 31, 32 and 33. The connections between the front glass plate 30 and the side glass plates 41, and between the back glass plate 14 and the side glass plates 41 are conducted by frit glass 39. Also tile fixation of the lead-in terminals 46 and 40 is conducted by the frit glass 39.

A cold cathode heater 13 is disposed between the back glass plate 14 and the cold cathode groups 36, 37 and 38. The cold cathode heater 13 is connected in, for example, a matrix form to the lead-in terminals 40 different from those to which the electron pulling electrodes 6 are connected. The lead-in terminals 40 are connected to the heater power source 44 so that all the microcones disposed in the cold cathode groups 36, 37 and 38 are directly heated.

Figure 10:
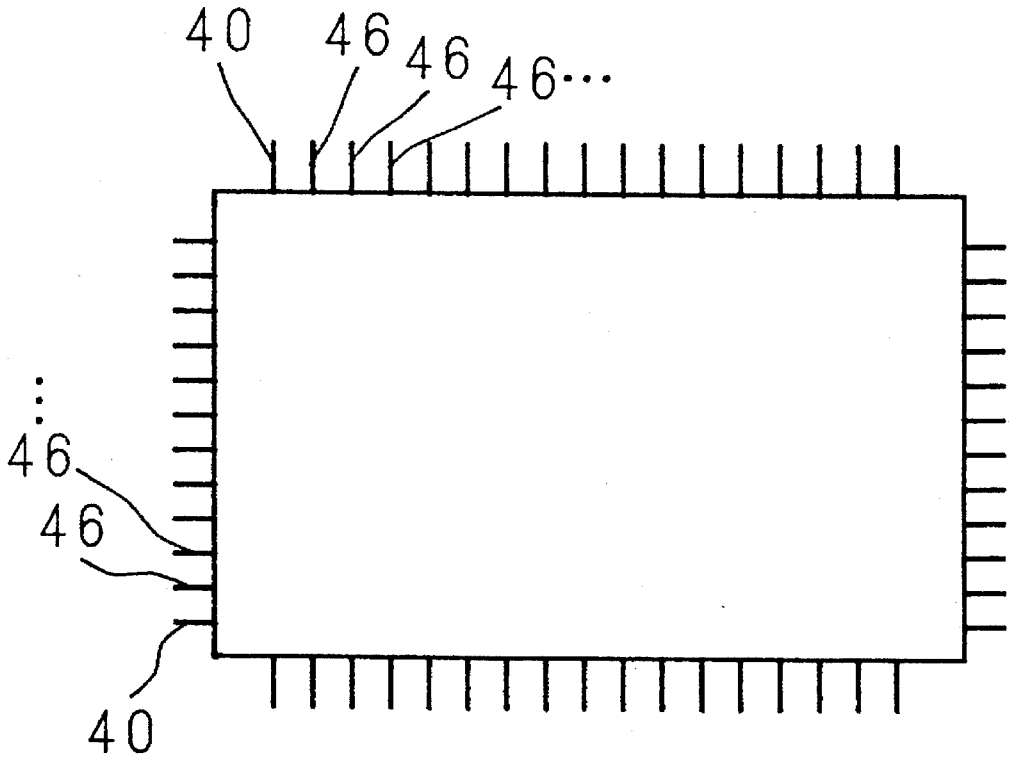
FIG. 10 is a front view of the cathode-ray tube shown in FIG. 9.

FIG. 10 is a front view of the flat cathode-ray tube as viewed from the front side. The lead-in terminals 40 project to the outside in a matrix form as shown in FIG. 10, and the cold cathode heater 13 and the electron pulling electrodes 6 are adequately connected to the lead-in terminals 40.

Embodiment 3

Figure 11:
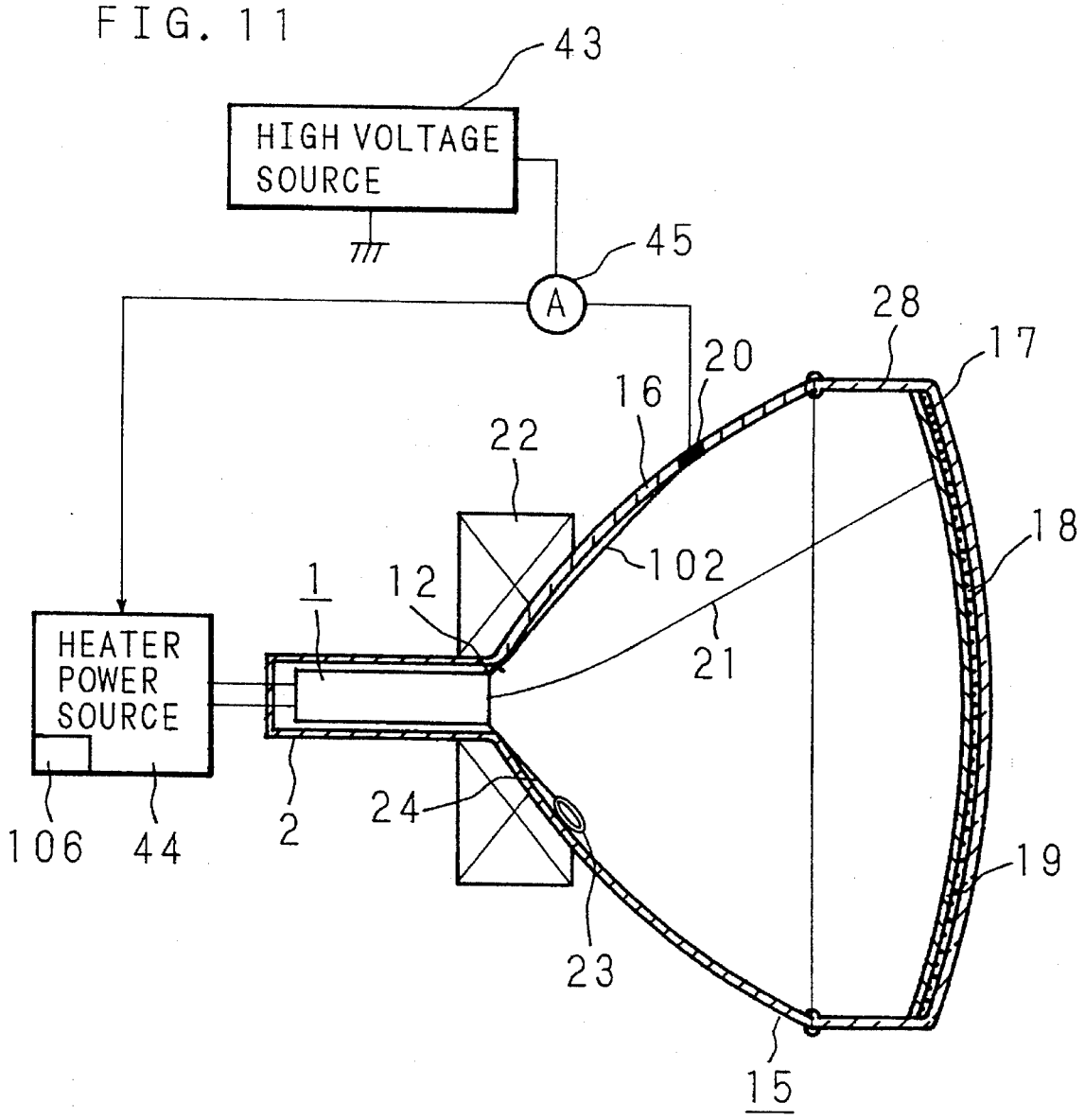
FIG. 11 is a schematic section view showing still another embodiment of the cathode-ray tube of the invention.

FIG. 11 is a schematic section view showing still another embodiment of the cathode-ray tube of the invention. The embodiment is so configured that the temperature of the tips of the minute projections 7*a* of the cold cathode 5 shown in FIG. 5 is controlled so that the emission current from the cold cathode 5 1s constant. In the embodiment, an ammeter 45 is disposed between the anode button 20 and the high voltage source 43, and the heater power source 44 is provided with a control unit 106 which controls the output voltage of the heater power source 44 on the basis of measurement results of the ammeter 45. The other configuration is identical with that of FIG. 5. Therefore, corresponding elements are designated by the same reference numerals and their description is omitted.

The control unit 106 controls the output voltage of the heater power source 44 so that the temperature of minute projections 7*a* is constant within the range of 100° to 500° C. This can stabilize surely and efficiently the amount of emitted electron rays.

Embodiment 4

Figure 12:
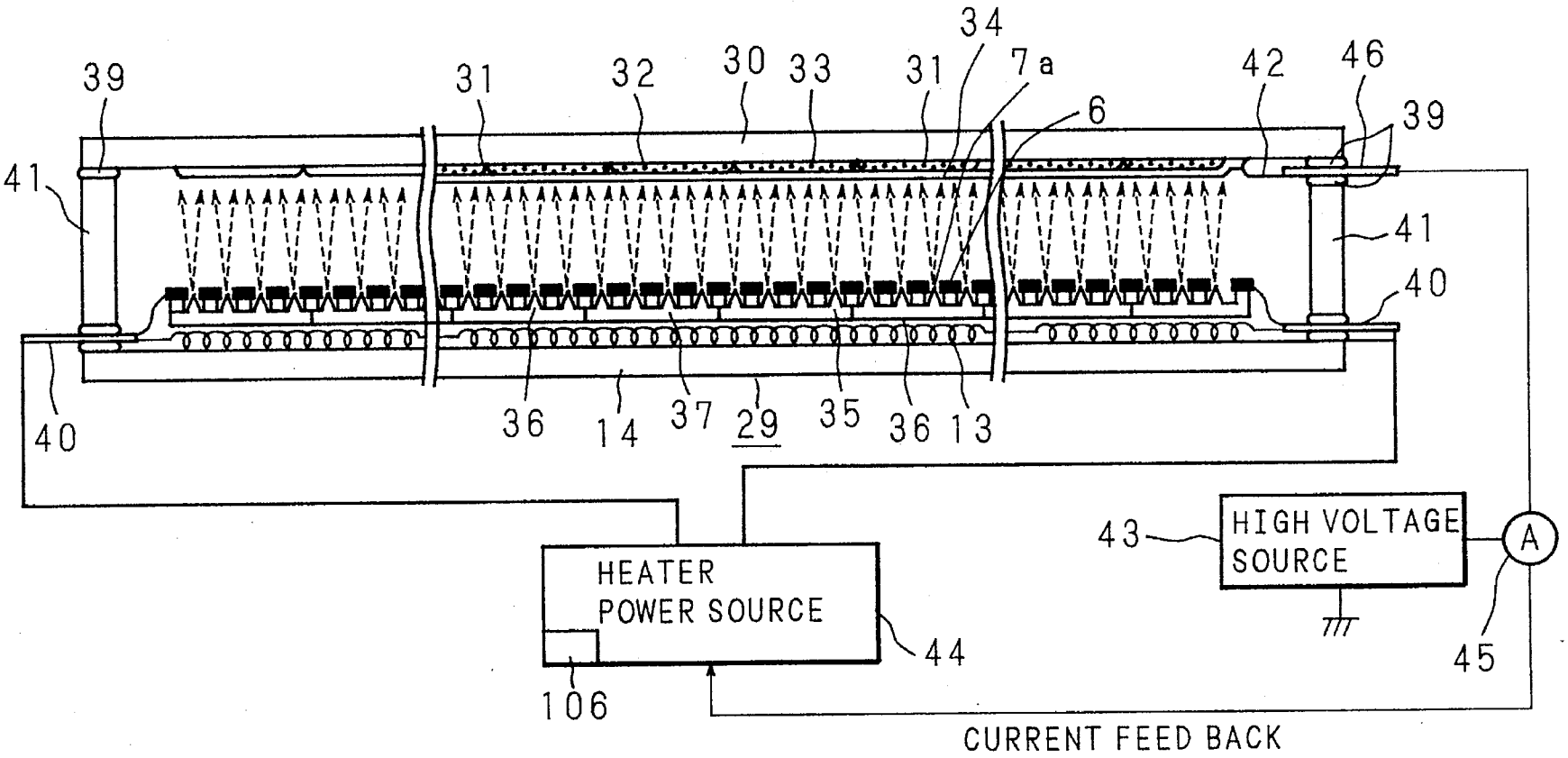
FIG. 12 is a schematic section view showing still another embodiment of the cathode-ray tube of the invention.

FIG. 12 is a schematic section view showing still another embodiment of the cathode-ray tube of the invention. The embodiment is so configured that the temperatures of the tips of the minute projections 7*a* of the cold cathode groups 36, 37 and 38 shown;in FIG. 8 are controlled so that the emission currents from the cold cathode groups 36, 37 and 38 are constant. In tile embodiment, an ammeter 45 is connected between the lead-in terminal 46 and the high voltage source 43, and all electron emission adjust unit 106 controls the output of the heater power source 44 on the basis of measurement results of the ammeter 45.

In a process in which a high voltage is applied to the metal back film 34 and electrons pulled out from the minute projections 7*a* by the electron pulling electrodes 6 are accelerated toward the G, B and R fluorescent dots 31, 32 and 33, the ammeter 45 measures a fluorescent screen current flowing through the metal back film 34. The electron emission adjust unit 106 disposed in the heater power source 44 conducts a feedback control so that the level of the current is constant., and the voltage applied to the cold cathode heater 13 is controlled, whereby the emission currents from the cold cathode groups 36, 37 and 38 can be stabilized.

The invention can be applied to either of a monochrome cathode-ray tube, or a color cathode-ray tube having a plurality of cathodes. Although embodiments of a bipotential electron gun have been described, the configuration of the electron gun in the invention is not restricted to a bi-potential electron gun, and the invention can similarly be applied to electron guns of another configurations.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cathode which emits electrons toward a fluorescent layer functioning as an anode, comprising:

an electron emission portion having a projection, a tip of said projection being sharpened;

an electron pulling electrode which is disposed in the vicinity of said tip and which pulls out electrons from said tip; and a heat source which heats said electron emission portion during electron emission, thereby preventing said tip from adsorbing gas molecules.

2. A cathode according to claim 1, wherein said heat source is placed in a side of the base of said electron emission portion.

3. A cathode according to claim 1, further comprising control means for controlling heating temperature by said heat source.

4. A cathode according to claim 3, wherein said control means controls the heating temperature by said heat source within the range of 100° to 500° C.

5. A cathode according to claim 3, wherein said control means conducts a control so that the amount of electrons pulled out from said electron emission portion is constant.

6. An electron gun which accelerates and focuses electrons emitted from a cathode toward a fluorescent layer functioning as an anode, comprising:

an electron emission portion having a projection, a tip of said projection being sharpened;

an electron pulling electrode which is disposed in the vicinity of said tip of said electron emission portion and which pulls out electrons from said tip;

a heat source which heats said electron emission portion during electron emission, thereby preventing said tip from adsorbing gas molecules;

an acceleration electrode which is disposed in a side of said fluorescent layer of said electron pulling electrode and which accelerates electrons pulled out by said electron pulling electrode; and a focusing electrode which is disposed in a side of said fluorescent layer of said electron pulling electrode and which focuses electrons pulled out by said electron pulling electrode.

7. An electron gun according to claim 6, wherein said heat source is placed in a side of the base of said electron emission portion.

8. An electron gun according to claim 6, further comprising control means for controlling heating temperature by said heat source.

9. An electron gun according to claim 8, wherein said control means controls the heating temperature by said heat source within the range of 100° to 500° C.

10. An electron gun according to claim 8, further comprising an ammeter measuring a current flowing through said focusing electrode which focuses said electron rays, wherein said control means controls the heating temperature by said heat source so that measurement result of said ammeter are constant.

11. A cathode-ray tube in which electrons emitted from a cathode are accelerated and focused to impinge on a fluorescent layer functioning as an anode, comprising:

an electron emission portion having a projection, a tip of said projection being sharpened;

an electron pulling electrode which is disposed in the vicinity of said tip of said electron emission portion and which pulls out electrons from said tip;

a heat source which heats said electron emission portion during electron emission, thereby preventing said tip from adsorbing gas molecules;

an acceleration electrode which is disposed in a side of said fluorescent layer of said electron pulling electrode and which accelerates electrons pulled out by said electron pulling electrode;

a focusing electrode which is disposed in a side of said fluorescent layer of said electron pulling electrode and which focuses electrons pulled out by said electron pulling electrode; and a fluorescent screen having a fluorescent layer and a metal film on which electrons focused by said focusing electrode impinge.

12. A cathode-ray tube according to claim 11, wherein said heat source is placed in a side of the base of said electron emission portion.

13. A cathode ray tube according to claim 11, further comprising control means for controlling heating temperature by said heat source.

14. A cathode-ray tube according to claim 13, wherein said control means controls the heating temperature by said heat source within the range of 100° to 500° C.

15. A cathode-ray tube according to claim 13, further comprising an ammeter measuring a current flowing through said metal film, wherein said control means controls the heating temperature by said heat source so that measurement results of said ammeter are constant.

* * * * *

UNITED STATES PATENT AND TRADEMARK OFFICE

CERTIFICATE OF CORRECTION

PATENT NO. : 5,491,375
DATED : February 13, 1996
INVENTOR(S) : Iwasaki

It is certified that error appears in the above-indentified patent and that said Letters Patent is hereby corrected as shown below:

Title page, item [54] and col. 1, line 4, delete "EMISSON" and insert--EMISSION--.

Column 3, line 65, after "at a high" insert --vacuum.--

Drawings:

Replace FIG. 7 with the correct FIG. 7 attached hereto.

Signed and Sealed this

Twenty-seventh Day of August, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,491,375
DATED : February 13, 1996
INVENTOR(S) : Iwasaki

It is certified that error appears in the above-indentified patent and that said Letters Patent is hereby corrected as shown below:

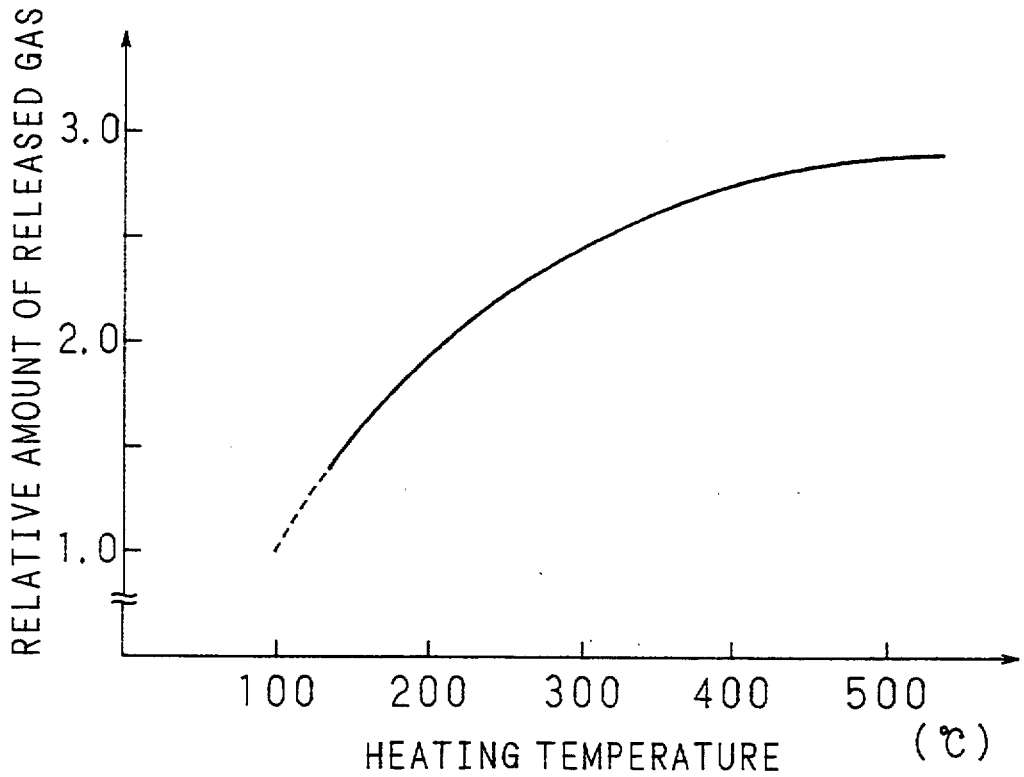

FIG. 7